US010689928B2

(12) United States Patent
Elgsæter et al.

(10) Patent No.: US 10,689,928 B2
(45) Date of Patent: Jun. 23, 2020

(54) METHOD AND SYSTEM FOR MANAGED PRESSURE DRILLING

(71) Applicant: EQUINOR ENERGY AS, Stavanger (NO)

(72) Inventors: Steinar Elgsæter, Trondheim (NO); Christian Bratli, Askim (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/307,839

(22) PCT Filed: Jun. 2, 2017

(86) PCT No.: PCT/NO2017/050143
§ 371 (c)(1),
(2) Date: Dec. 6, 2018

(87) PCT Pub. No.: WO2017/213513
PCT Pub. Date: Dec. 14, 2017

(65) Prior Publication Data

US 2019/0301254 A1 Oct. 3, 2019

(30) Foreign Application Priority Data

Jun. 7, 2016 (GB) ..... 1609894.9

(51) Int. Cl.
*E21B 21/08* (2006.01)
*E21B 47/06* (2012.01)

(52) U.S. Cl.
CPC ..... *E21B 21/08* (2013.01); *E21B 47/06* (2013.01)

(58) Field of Classification Search
CPC ..... E21B 21/08; E21B 47/06
See application file for complete search history.

(56) References Cited

U.S. PATENT DOCUMENTS 7,044,237 B2 5/2006 Leuchtenberg
9,938,816 B2 * 4/2018 Astrid ..... E21B 44/04
(Continued)

FOREIGN PATENT DOCUMENTS

GB 2473672 A 3/2011
WO WO 2008/016717 A2 2/2008
(Continued)

OTHER PUBLICATIONS

International Search Report, issued in PCT/NO2017/050143, dated Aug. 7, 2017.
(Continued)

*Primary Examiner* — Thomas C Lee
*Assistant Examiner* — Anzuman Sharmin
(74) *Attorney, Agent, or Firm* — Birch, Stewart, Kolasch & Birch, LLP

(57) ABSTRACT

A method for use with a managed pressure drilling (MPD) system, the system including a drill string having a drill bit, an annulus defined outside of the drill string, a mud pump for pumping mud down through the drill string and back up through the annulus, a control choke in an extraction path coupled to the annulus, a back pressure pump also coupled to the extraction path, and a programmable logic controller (PLC) for controlling the control choke, the method including: a) performing measurements to determine a dataset including, for each of a plurality of time steps k: a value of fluid flow rate through the drill bit $q_{bit}[k]$, a value of fluid flow rate through the control choke $q_c[k]$, a value of fluid flow rate from the back pressure pump $q_{bpp}[k]$ and a value of fluid pressure at the control choke $p_c[k]$; b) executing an inversion algorithm on the PLC to obtain a value for the bulk modulus of a fluid within the annulus, the inversion algorithm taking the dataset as an input, wherein the inversion algorithm accounts for a measurement bias $b_q$ in one or more
(Continued)

of said measurements; c) updating one or more control parameters of the PLC based on the value for the bulk modulus; and d) manipulating the control choke using the PLC to attain a desired pressure in the system.

36 Claims, 3 Drawing Sheets

(56) References Cited

U.S. PATENT DOCUMENTS

2005/0092523 A1* 5/2005 McCaskill ..... E21B 21/08 175/38
2005/0096848 A1 5/2005 Hou et al.
2005/0269134 A1 12/2005 Strazhgorodskiy
2006/0265199 A1* 11/2006 Guhring ..... G06K 9/0057 703/2
2010/0121580 A1* 5/2010 Jacques ..... E21B 49/008 702/11
2012/0247831 A1* 10/2012 Kaasa ..... E21B 21/08 175/25
2017/0037690 A1* 2/2017 Hardt ..... E21B 21/08
2017/0370151 A1* 12/2017 Banirazi-Motlagh ..... G05B 15/02
2018/0172860 A1* 6/2018 Wilson ..... G01V 1/50

FOREIGN PATENT DOCUMENTS

WO WO 2014/204316 A1 12/2014
WO WO 2015/179408 A1 11/2015
WO WO 2016/140650 A1 9/2016

OTHER PUBLICATIONS

United Kingdom Combined Search and Examination Report, issued in Priority Application No. 1609894.9, dated Nov. 16, 2016.
Written Opinion of the International Searching Authority, issued in PCT/NO2017/050143, dated Aug. 7, 2017.

* cited by examiner

METHOD AND SYSTEM FOR MANAGED PRESSURE DRILLING

TECHNICAL FIELD

The invention relates to a method and system for managed pressure drilling.

BACKGROUND

The International Association of Drilling Contractors (IADC) defines managed pressure drilling (MPD) as an adaptive drilling process used to precisely control the annular pressure profile throughout a wellbore. The objectives are to ascertain the down hole pressure environment limits and to manage the annular hydraulic pressure profile accordingly. MPD systems comprise a closed pressure system for providing automatic control of the backpressure within a wellbore during a drilling process [or other drilling and completion operations].

The bulk modulus of a substance measures the substance's resistance to uniform compression. It is defined as the ratio of the infinitesimal pressure increase to the resulting relative decrease of the volume. In conventional MPD systems, nominal values of bulk modulus are used, which do not account for cuttings, temperature variations, and other real-world effects. The effective bulk modulus describes the compressibility of the fluids in the annulus. The fluid compressibility can vary by at least a factor of four in a conventional drilling operation. As the fluid compressibility changes so to do the dynamics of the drilling process. This has implications for the optimal MPD controller settings such as gain. The bulk modulus is affected by several factors which make it difficult to estimate, e.g. gas in the drilling mud, expansion of the casing and wellbore, and temperature gradients all contribute to the overall effective bulk modulus of the annulus.

An MPD system is described in GB2473672 B. The following patent documents are also concerned with MPD systems; WO2008016717, US2005269134, US2005092523, US2005096848 and U.S. Pat. No. 7,044,237.

SUMMARY

Aspects of the invention are set out in the claims.

The inventors have appreciated that by giving an MPD control system a better (i.e. more accurate) estimate of the effective bulk modulus, rather than just a nominal, 'guessed' value, one can expect MPD control to perform better. The effective bulk modulus is the lumped bulk modulus of the fluids in the annulus—a varying combination of drilling mud, and possibly gas bubbles, sand, drilling chemicals and possibly other fluids and particles. The inventors appreciate that with an improved estimate of the effective bulk modulus, as is made available by the invention, the MPD control system is able to more accurately control the downhole pressure during drilling—which is important for the safety and performance of the drilling campaign. If the effective bulk modulus is not known, or if only a poor estimate of it is available (e.g. one which is out of date such that the well conditions are no longer the same as when the value was determined), it is difficult for the MPD control system to predict the dynamic response of changes in annulus pressure and flow. Thus for an MPD control system, accurate knowledge the effective bulk modulus is important as it strongly influences the dynamic modes of the annulus pressure/flow dynamics.

The inventors have also appreciated that measurements made on the MPD system, e.g. in order to estimate the effective bulk modulus, may be biased and that if this bias is left uncompensated the estimate of the effective bulk modulus could be very poor, with implications for the performance of the MPD system. The invention thus also provides a way to identify and correct for measurement bias when estimating the effective bulk modulus, thereby resulting in an improved estimate of the effective bulk modulus and hence improved performance of the MPD system. The measurement bias correction may account for calibration offset, measurement uncertainty or readout error in one or more flow meters of the MPD system. For example, a particular flow meter in the MPD system may consistently give an output value which is artificially inflated by a constant amount. If no correction for this is made, since the true flow rates are quite different from those used to estimate the effective bulk modulus, one can expect the estimate of the bulk modulus to be inaccurate. It is therefore desirable that the MPD control system is able to identify and correct for measurement biases when estimating the bulk modulus. Biases could include constant offsets, scale factors and/or systematic noise in the readouts from one or more flow meters/pressure sensors in the MPD system.

The inventors have further appreciated that it is desirable to execute an inversion algorithm to determine the bulk modulus, including the correction for measurement bias, directly on a programmable logic controller (PLC) of the MPD system, rather than on a separate computer system. This is challenging owing to the limited memory and computational capability of the PLC. The invention provides algorithms which are suitable for implementation and execution on a PLC. As such, an entire dataset comprising flow rates and pressures sampled at multiple points in time may not be stored in its entirety in the PLC. Instead, the PLC may process data on-the-fly as they are collected by sensors—something which is allowed for due to the recursive nature of the algorithms described herein.

The inventors have appreciated that a further motivation for estimating effective bulk modulus is that it may give an indication of gas influx or bubbles escaping the system at low pressures—thereby allowing a kick or loss to be identified.

Disclosed herein is a method for use with a managed pressure drilling (MPD) system, the system comprising a drill string having a drill bit, an annulus defined outside of the drill string, a mud pump for pumping mud down through the drill string and back up through the annulus, a control choke in an extraction path coupled to the annulus, a back pressure pump also coupled to the extraction path, and a programmable logic controller (PLC) for controlling the control choke, the method comprising:

a) performing measurements to determine a dataset comprising, for each of a plurality of time steps k: a value of fluid flow rate through the drill bit $q_{bit}[k]$, a value of fluid flow rate through the control choke $q_c[k]$, a value of fluid flow rate from the back pressure pump $q_{bpp}[k]$ and a value of fluid pressure at the control choke $p_c[k]$;

b) executing an inversion algorithm on the PLC to obtain a value for the bulk modulus of a fluid within the annulus, the inversion algorithm taking the dataset as an input, wherein the inversion algorithm accounts for a measurement bias $b_q$ in one or more of said measurements;

c) updating/optimizing one or more parameters of the PLC, or a proportional-integral-derivative (PID) controller connected to the PLC, based on the obtained value for the bulk modulus; and d) manipulating the control choke and/or the back pressure pump (i.e. configuring the extraction path) using the PLC/PID controller to attain a desired pressure in the system, wherein said updated/optimized control parameters are used by the PLC/PID controller in said manipulating.

The one or more control parameters may be a gain and/or a time constant. In a first example, a proportional-integral-derivative (PID) controller may form part of the MPD system, wherein the PID controller is linked to the PLC. In this case, the effective bulk modulus which is determined by the calculations preformed on the PLC (in step b above) may have a bearing on the optimal parameters of the PID controller. For example, for a given determined effective bulk modulus at a particular point in time it may be desirable to vary the proportional, integral and derivative terms used by the PID controller to account for a change in the compressibility of the annulus fluid. The PLC may determine the optimal PID values based on the estimated bulk modulus, and the PLC may configure the PID controller accordingly over a connection interface provided between the PID controller and the PLC.

Alternatively, the PLC may implement a form of model predictive control, MPC, such as that described in GB2473672 B. In MPC, the effective bulk modulus may be a parameter which is used in a model (e.g. an equation) to calculate, on the PLC itself, a desired extraction flow rate from the wellbore annulus which will allow a desired annulus pressure to be attained. This desired extraction flow rate may be set by adjusting the control choke and/or back pressure pump in the extraction flow path of the MPD system. Such model predictive control relies on an accurate determination of the effective bulk modulus, amongst other parameters, and therefore will be improved by the techniques disclosed herein which allow calculation of the effective bulk modulus directly on a PLC controller in near real time.

BRIEF DESCRIPTION OF THE DRAWINGS

Some embodiments of the invention will now be described by way of example only and with reference to the accompanying drawing, in which.

DETAILED DESCRIPTION

Figure 1:
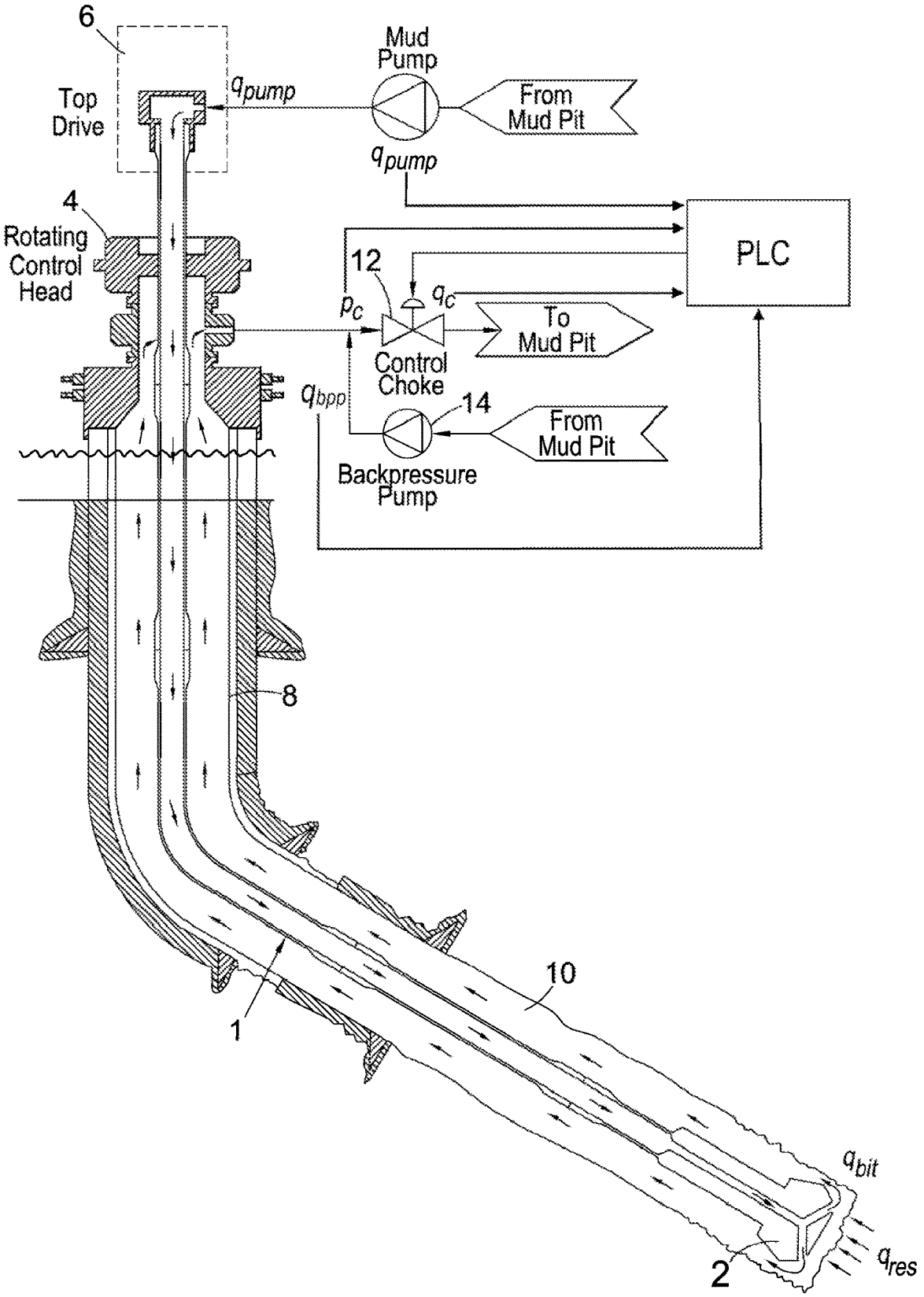
FIG. 1 illustrates schematically a managed pressure drilling (MPD) system.

FIG. 1 shows a Managed Pressure Drilling (MPD) system comprising a drill string 1 having a drill bit 2, a control head 4 and a top drive 6. A wellbore 8 defines an annulus 10 between the wellbore 8 and the drill string 1, and containing drilling fluid. During operation, drilling fluid is pumped from the top drive 6, at a flow $q_{pump}$, down the drill string 1 to power the drill bit 2. In most cases the rotation of the drill bit is powered by the top drive 6 which rotates the entire drill string. However, in some cases the fluid flow may also cause the rotation of the drill bit. Often, the fluid flow powers a turbine that generates power for downhole sensors and transmitters used transmit data signals to the surface by pulse telemetry. The drilling fluid exits through the drill bit 2 into the downhole annulus and returns up through the annulus 10. Upon reaching the topside of the annulus, the drilling fluid exits the control choke at a flow $q_c$. The flow rate $q_c$ is a variable that is controlled so as to maintain a predetermined pressure profile within the annulus 10. For example, the flow $q_c$ can be controlled by a control choke 12 and backpressure pump 14 which maintains sufficient backpressure within the MPD system. Fluid may also enter or exit the annulus 10 via the reservoir (for example through pores in the wellbore at a flow $q_{res}$. $q_{bpp}$ is the fluid flow rate from the back pressure pump, $q_{bit}$ is the fluid flow rate at the drill bit, $q_c$ is the fluid flow rate through the control choke and $q_{pump}$ is the fluid flow rate from the mud pump. $q_{bit}$ is typically estimated from $q_{pump}$. $p_c$ is the fluid pressure at the control choke. A programmable logical controller (PLC) monitors various parameters such as $q_{pump}$, $q_c$, $q_{bpp}$ and $p_c$ and manipulates the control choke to maintain a predetermined pressure profile.

The bulk modulus of a substance characterizes the substance's resistance to uniform compression. It is defined as the ratio of the infinitesimal pressure increase to the resulting relative decrease of the volume. The integrated MPD system identifies the effective bulk modulus of the drillstring annulus, meaning the lumped bulk modulus of the fluids in the annulus, a varying combination of drilling mud, and possibly gas bubbles, sand, drilling chemicals and possibly other fluids and particles. The MPD system can also identify the combined/joint bulk modulus of the drillstring annulus and the drillstring itself.

The annulus bulk modulus equation (1) equates choke pressure ($p_c$), flow rates in and out of the annulus ($q_{bpp}$, $q_{bit}$, $q_c$), annulus volume ($V_a$) and the bulk modulus of the annulus ($\beta_a$):

$$\dot{p}_c = \frac{\beta a}{V_a} \cdot (q_{bpp} + q_{bit} - q_c), \tag{1}$$

where $q_{bpp}$ is the flow rate measured at the back-pressure pump, $q_{bit}$ is the flow rate measured at the drill bit and $q_c$ is the flow rate measured through the control choke.

The motivation for estimating $\beta_a$ in drilling pressure control, is that the effective bulk modulus describes the compressibility of the fluids in the annulus, this compressibility can vary by at least a factor of four, and as compressibility changes, the dynamics of the drilling process changes, and this has implications for the PLC settings such as gain and time constants. Another motivation for estimating effective bulk modulus is that it may give an indication of gas influx or bubbles escaping the system at low pressures.

However, there are several challenges involved in estimating $\beta_a$, such as:

1. The computational effort available is limited by the PLC's processing power, memory and real-time requirements, requiring a recursive implementation;
2. The flow rates in equation (1) are subject to a measurement uncertainty, and will often be biased (possibly due to calibration offsets in one or more flow meters or read-out errors). If this flow rate bias $b_q$ is not corrected for, the estimated $\beta_a$ will be significantly wrong; and
3. $\beta_a$ cannot be estimated by simply inverting (1) as both the left- and right-hand side are zero during steady-state conditions, and measurements are often overlayed by un-modeled pump-flow dynamics.

In the following equations, $\hat{\bullet}$ denotes an estimate and $\bar{\bullet}$ denotes a measurement.

An algorithm according to a first embodiment of the invention will now be described. The bulk modulus equation (1) combined with Euler's integration method gives:

$$\frac{1}{V_A}\cdot(q_{bpp}[i]+q_{bit}[i]-q_c[i])\cdot\beta_a=\frac{p_c[i+1]-p_c[i]}{dT} \quad (2)$$

where dT is the time-step between samples, and i refers to sample number. Integrating n steps forward with (2) can be written as:

$$\hat{p}_c[n]-p_c[1]=\alpha(b_q)[n]\cdot\beta, \quad (3)$$

where $$a[n]=\sum_{i=1}^{n-1}\hat{q}_{bit}[i]+\overline{q}_{bpp}[i]-\overline{q}_c[i], \text{ and} \quad (4)$$

$$\alpha(b_q)[n]=a(n)+\frac{dT}{V_a}\cdot b_q\cdot\sum_{k=1}^{n-1}k. \quad (5)$$

Let $Z^N$ refer to a set of measured data for N time steps, in this case a[n] and $p_c[n]$ over n=1, 2, . . . , N. The parameter estimate that fits a data set $Z^N$ can best be found by solving the optimization problem $$\min_{\beta,b_q}V(\beta,b_q,Z^N), \quad (6)$$

for the quadratic objective function $$V(\beta,b_q,Z^N)=\Sigma_{i=1}^{n}(\overline{p}_c[i]-\hat{p}_c(\hat{\beta},\hat{b}_q)[i])^2. \quad (7)$$

Multiplying out the squared term in (7), combining with (3) and solving for $$\frac{dV(\beta,b_q)}{d\beta}=0 \quad (8)$$

gives the exact minimum of the convex optimization problem of finding $\hat{\beta}$ for a given $b_q$:

$$\frac{d}{d\beta}\sum_{j=1}^{n}(\Delta\overline{p}_c[j]-\beta\cdot\alpha(b_q)[j])^2=0, \quad (9)$$

where $\Delta\overline{p}_c[j]=p_c[j+1]-p_c[j]$. Equation (9) holds when $$\Sigma_{j=1}^{n}\Delta\overline{p}_c[j]-\beta\cdot\alpha(b_q)[j]=0, \quad (10)$$

which gives an explicit solution for the estimate $\hat{\beta}$ that best fits data for a given $b_q$:

$$\hat{\beta}(b_q)=\frac{\sum_{j=1}^{n}\Delta\overline{p}_c[j]}{\sum_{j=1}^{n}\alpha(b_q)[j]}. \quad (11)$$

From an implementation standpoint, especially for implementation on a PLC, it is very beneficial that (11) is evaluated by computing two sums, as this means that each entry data point in the data set $Z^N$ does not need to be kept in memory, rather only the two sums in (11) need to be updated and stored between iterations. This therefore significantly reduces the memory and processing requirements in order to estimate the bulk modulus.

Similarly, when evaluating and comparing the value of the objective function, equation (7) can be solved out for individual terms such that:

$$V(\beta,b_q,Z^N)=\sum_{j=1}^{n}\Delta\overline{p}_c^2[j]+\sum_{j=1}^{n}\beta^2\cdot\left(a[j]^2+\frac{dT^2}{V_a^2}\cdot b_q^2\cdot j^2+2\cdot a[j]\frac{dT}{V_a}\cdot b_q\right)-\sum_{j=1}^{n}2\Delta\overline{p}_c[j]\beta\cdot a[j]-\sum_{j=1}^{n}2\Delta\overline{p}_c[j]\beta\cdot\frac{dT}{V_a}\cdot b_q\cdot j \quad (12)$$

Rather than keeping the entire dataset $Z^N$ in memory, it is preferable to keep just the value of the sums in the above equations (11) and (12) in memory, and update these sums at each iteration.

The above shows how for a given flow bias $b_q$ and data set $Z^N$, a bulk modulus estimate can be found according to equation (11). For each estimate $(\hat{\beta}_e, \hat{b}_q)$, a cost function (7) can be evaluated to rank the fit of the found parameter estimate.

To find the bias flow that best corresponds to the data, a search algorithm, i.e. an algorithm for finding an item with specified properties among a collection of items, is used. The algorithm operates as follows:

1. given an initial loose interval $(b_q^L, b_q^U)$ that bounds the region of plausible bias estimates,
2. implement a search algorithm on $b_q$, where for each $b_q$ a corresponding $\hat{\beta}_e$ is estimated through (11) and the value of the cost function (7) is attempted to be minimized.

In this particular implementation, the chosen search algorithm evaluates (7) in a window that is gradually refined around the most promising value found in previous iterations, a type of random search or direct search algorithm, as outlined below:

1. given a desired tolerance $S^{tol}$, $N_c$ the number of calculations performed at each step, and initial bounds $(b_q^L, b_q^U)$ on the variable to be found,
2. set the initial step size $S=(b_q^U-b_q^L)/N_c$,
3. evaluate (7) at $N_c$ evenly spaced values over $(b_q^L, b_q^U)$,
4. choose the estimate found in the step 3 with the lowest objective function value, call this estimate $b_q^{\hat{a}}$,
5. if $S>S^{tol}$, divide the step size S by $N_c$, update the bound by $b_q^L=b_q^L-S$ and $b_q^U=b_q^b+S$, and repeat steps 3-5.

The problem of solving for $(\beta, b_q)$ is non-convex and therefore challenging to solve numerically, especially with the additional requirement that the solver should be recursive and PLC-implementable. This embodiment is recursive in that it stores summed variables and adds the contribution of each new data point to the sums, rather than keeping the entire dataset $Z^N$ in memory and performing the calculation over the entire dataset at each step. This is a strong advantage for PLC implementation.

This embodiment uses derivation to find the exact minimum in terms of β, then uses a heuristic, computer-science based search algorithm to find the region in which the best fitting is $b_q$, then these two subproblems are solved sequentially while in each iteration narrowing the search window for $b_q$.

An algorithm according to a second embodiment of the invention will now be described. According to this second embodiment, the integrated MPD system will consider a discretized version of the annulus bulk modulus equation. The flow rate bias to be determined is denoted $b_q$, such that (1) becomes $$p_c[k] = p_c[k-1] + \frac{\Delta t \cdot \beta_a}{V_a} \cdot (q_{bpp}[k] + q_{bit}[k] - q_c[k] + b_q). \tag{13}$$

Introducing Variables $$y[k]=p_c[k], \text{ and} \tag{14}$$

$$u[k]=q_{bpp}[k]+q_{bit}[k]-q_c[k], \tag{15}$$

from equation (13) the change in pressure between time 0 and time k (using Euler integration), for a given flow rate bias $b_q$ is given by:

$$\bar{y}[N] - \bar{y}[0] = \beta_a \cdot \frac{\Delta t}{V_a}\left(\sum_{k=1}^{N}(u[k]) + N \cdot b_q\right). \tag{16}$$

Assume that a loose lower and upper bound on $\beta_a \in (\beta_{min}, \beta_{max})$ is known, then (16) can be related to an upper- and lower bound on the bias $b_q$:

$$b_q^1 = \frac{1}{N}\left((\bar{y}[N] - \bar{y}[0]) \cdot \frac{V_a}{dT \cdot \beta_{min}} - \sum_{k=1}^{N} u[k]\right), \tag{17}$$

$$b_q^2 = \frac{1}{N}\left((\bar{y}[N] - \bar{y}[0]) \cdot \frac{V_a}{dT \cdot \beta_{max}} - \sum_{k=1}^{N} u[k]\right). \tag{18}$$

We can then assert that the value of $b_q$ is between $(b_q^1, b_q^2)$. For a given $b_q$, an equation for the relative pressure change in terms of only $\beta_a$ is given by (16). The disadvantage of using (16) directly to estimate $\beta_a$ is that left- and right-hand sides can cross through zero even for large N, and that it only considers the pressure measured at two points. These considerations motivate considering a second equation for $\beta_a$, which considers the sum of the absolute value of the the pressure change, which is found by adding the absolute value operator on both sides of the equal sign in (16), to give:

$$\sum_{k=1}^{N} |\Delta\bar{y}[k]| = \beta_a \cdot \frac{\Delta t}{V_a} \cdot \sum_{k=1}^{N} \left|\bar{u}[k] + \hat{b}_q[k]\right|, \tag{19}$$

where $\Delta\bar{y}[k]=\bar{y}[k]-\bar{y}[k-1]$.

In contrast to (16), equation (19) will consider the y[k] at every time step between 1 and N, and the terms on both sides can never cross through zero. A possible disadvantage of (19) is that it can add up noise in measurements over time. To counter-act this, a low-pass filter L(·) is applied to both measurements, giving:

$$\sum_{k=1}^{N} |L(\Delta\bar{y}[k])| = \beta_a \cdot \frac{\Delta t}{V_a} \cdot \sum_{k=1}^{N} \left|L(\bar{u}[k]) + \hat{b}_{q,l}[k]\right|. \tag{20}$$

Both (16) and (20) can be solved for $\hat{\beta}_a$. Equations (16) and (20) can be written on the form $$Y=\Phi \cdot \beta_a, \tag{21}$$

where:

$$Y[k] = \begin{bmatrix} \sum_{t=1}^{k} |L(\Delta\bar{y}[t])| \\ \bar{y}[k] - \bar{y}[0] \end{bmatrix}, \text{ and} \tag{22}$$

$$\Phi[k] = \begin{bmatrix} \frac{\Delta t}{V_a} \cdot \sum_{t=1}^{k} \left|(L(\bar{u}[t]) + \hat{b}_q[t])\right| \\ \frac{\Delta t}{V_a} \cdot \left(\sum_{t=1}^{k} L(\bar{u}[t]) + \hat{b}_q[k] \cdot k\right) \end{bmatrix}. \tag{23}$$

Given $\hat{b}_q$, an estimate $\hat{\theta}=[\hat{\beta}_a, \hat{b}_q]$ can be found by determining $\Phi[k]^{-1}$ using a pseudo-inverse, such that $$\hat{\beta}_a[k]=\Phi[k]^{-1} \cdot Y[k]. \tag{24}$$

Equation (24) is suited for recursive implementation, i.e. well suited for implementation on a PLC. The three sums required for (24) are:

$$S[k] = \sum_{t=1}^{k} |L(\Delta\bar{y}[t])|, \tag{25}$$

$$P[k] = \frac{\Delta t}{V_a} \cdot \sum_{t=1}^{k} \left|(L(u[t]) + \hat{b}_q[t]\right|, \text{ and} \tag{26}$$

$$Q[k] = \frac{\Delta t}{V_a} \cdot \sum_{t=1}^{k} L(\bar{u}[t]), \tag{27}$$

which can all be stored between iterations and updated based on the newest data. Equations (22)-(23) can be written in the form:

$$Y[k] = \begin{bmatrix} S[k] \\ \bar{y}[k] - \bar{y}[0] \end{bmatrix}, \text{ and} \tag{28}$$

$$\Phi[k] = \begin{bmatrix} P[k] \\ Q[k] + k \cdot \hat{b}_q[t] \end{bmatrix}. \tag{29}$$

In addition, equations (17)-(18) require:

$$R[k]=\Sigma_{l=1}^{k} u[l]. \tag{30}$$

The approach to estimating the bias and bulk modulus is summarized by the following algorithm:

Given an initial loose estimate of $\beta_{min}$, $\beta_{max}$, and $\hat{b}_q=0$.

Initially set S[0]=P[0]=Q[0]=R[k]=0.

For each new iteration with index k, and given y[k] and ft [k]:

1. update $S[k]=S[k-1]+|L(\Delta\bar{y}[k])|$
2. update $P[k]=P[k-1]+|L(\bar{u}[k])+\hat{b}_q)|$
3. update $Q[k]=Q[k-1]+L(\bar{u}[k])$
4. update $R[k]=R[k-1]+u[k]$
5. calculate (17)-(18), and update bias estimate by
   (a) $\hat{b}_q=\min(\hat{b}_q, \max(b_{q1}, b_{q2}))$
   (b) $\hat{b}_q=\max(\hat{b}_q, \min(b_{q1}, b_{q2}))$
6. find $\hat{\beta}[k]$ by solving (24), (28) and (29) using a pseudo-inverse, for example by means of a singular value decomposition.

This second embodiment of the invention solves for β and $b_q$ simultaneously. It relies on mathematical manipulation of the differential equation (1) that describes the relation between bulk modulus and measured flow rates and pressures, so that the equation can be solved for bulk modulus.

Through mathematical manipulation, the problem of determining both the bulk modulus and the presence of a bias in the measured flow rates is reduced to a simple equation set in terms of two bounds and two equations in terms of sums. This embodiment relies on solving a 2×2 linear equation system at each iteration, and therefore the method is very computationally efficient and the computational time is predictable, which is advantageous in terms of maintaining real-time requirements and in terms of the low computational power that may be present in a PLC. In addition to the low-pass filter, it may also be beneficial to add a 'forgetting factor' to prevent the algorithm summing up noise over large data sets. This could be achieved by subtracting old values from the sums periodically, thereby reducing the 'memory' of the algorithm for past events. This could be especially advantageous if the method is to be run continuously. This embodiment, as with the first embodiment described above, is also recursive in that it stores summed variables and adds the contribution of each new data point to the sums, rather than keeping the entire dataset $Z^N$ in memory, a strong advantage for PLC implementation Both of the embodiments described above are implemented in software and can run on a PLC in the MPD control system. The system is available to the driller through a Graphical User Interface (GUI). During tuning, the driller would normally follow a predefined sequence of actions, e.g. a procedure where MPD chokes are varied at least once, but preferably several times up and down, so that the effects of the bulk modulus appear in the measured pressures and rates. Before performing these steps, the driller/operator would normally turn on the method by pressing a button in the GUI, which starts the computational procedure, which then calculates based on the received real-time data from the drilling rig. After having performed the steps of MPD choke opening/closing, the method will converge to an estimate of the bulk modulus and flow bias, and when convergence is achieved computations stop and the values are stored automatically and used by the MPD system in its internal models.

Both embodiments are suited for implementation on a PLC since they have low computational complexity and require low computational effort. This means that the algorithms can be implemented in drilling control systems and be made available to run at the press of a button for the driller. No manual calculations are required to use the methods—the algorithms themselves interpret measured values to produce an estimate. As new data arrives to the algorithms, this is added to sums that are kept in computer memory, thereby the estimates can be improved. As the entire history of measured variable values do not need to be stored, the methods are very efficient in terms of computer storage requirements.

Figure 2:
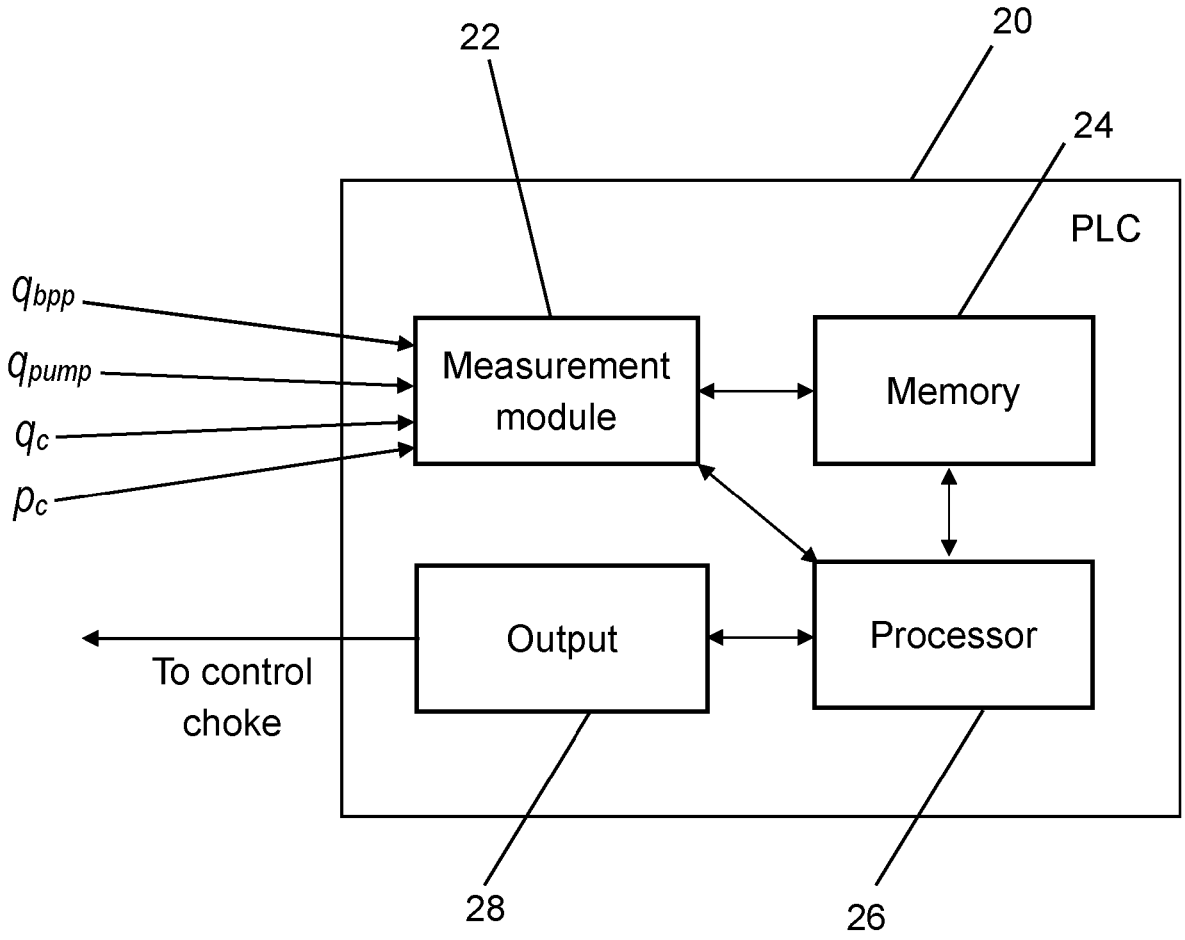
FIG. 2 illustrates schematically a programmable logic controller (PLC) employed as part of an MPD system.

FIG. 2 illustrates schematically a PLC 20 configured for use with the invention. The PLC comprises a measurement module 22, a memory 24, a processor 26 and an output 28. The measurement module is configured to perform measurements to determine $q_{bpp}[k]$, $q_{bit}[k]$, $q_c[k]$ and $p_c[k]$ (where $q_{bit}[k]$ is typically determined by measuring $q_{pump}[k]$). The memory stores data and control parameters such as gain and/or time constants. The processor executes an algorithm according to one of the embodiments described above. The output is connected to the adjustable choke to control a pressure in the system.

Figure 3:
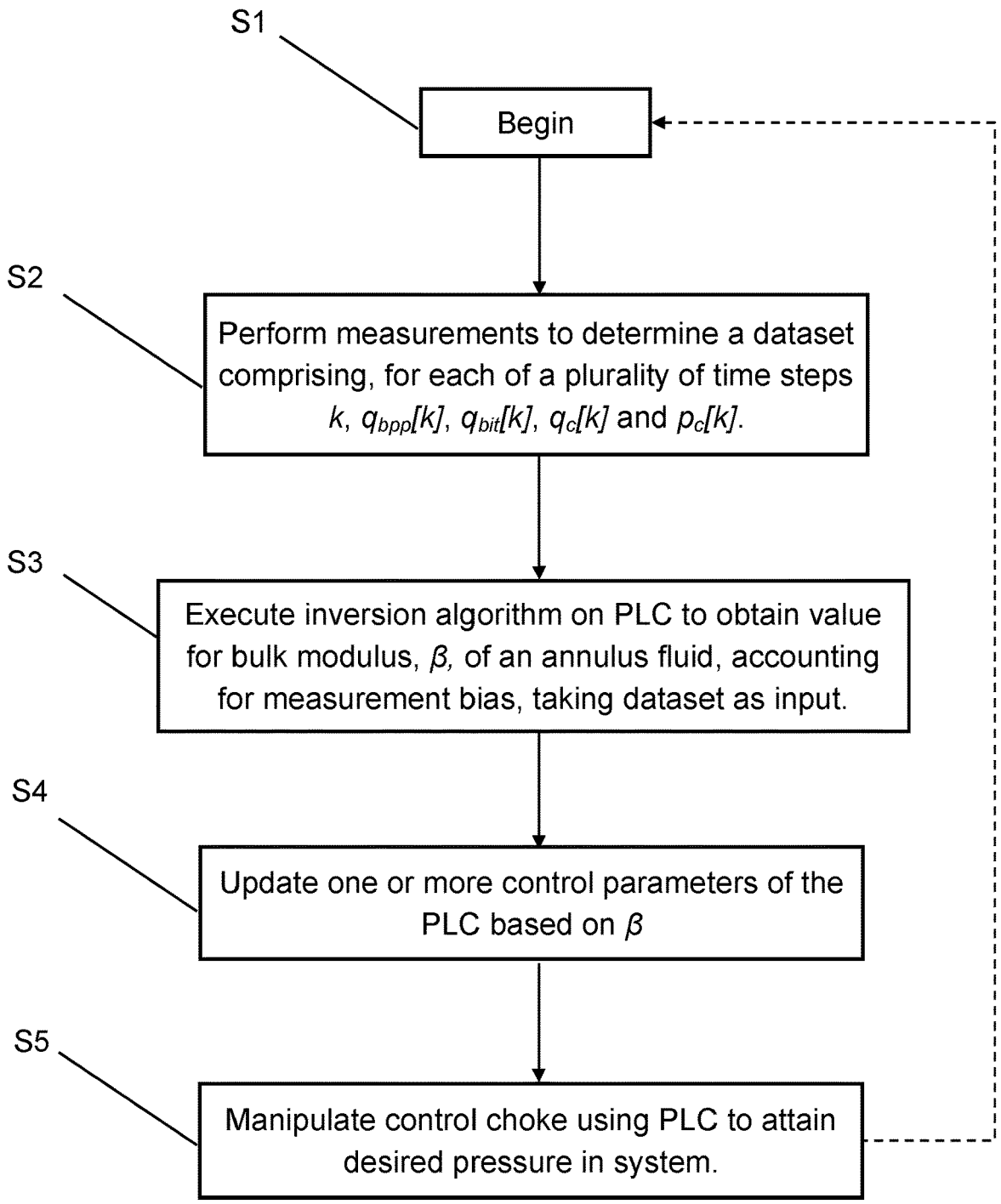
FIG. 3 is a flow diagram of a method for use with an MPD system.

FIG. 3 is a flow diagram illustrating the main steps of a method according to the invention. The process begins at step S1, e.g. by a drilling operator pressing a button on a GUI of a control system. At step S2 measurements are performed to determine a dataset comprising, for each of a plurality of time steps k, $q_{bpp}[k]$, $q_{bit}[k]$, $q_c[k]$ and $p_c[k]$. At step S3 an inversion algorithm (e.g. according to the first or second embodiment detailed above) is executed on the PLC to obtain a value for the bulk modulus of an annulus fluid, accounting for measurement bias in the process. At step S4 one or more control parameters of the MPD system (e.g. gain, time constant) are updated based on the determined value of the bulk modulus and these are stored in a memory of the PLC. At step S5 the PLC manipulates the control choke of the MPD system to attain a desired pressure in the system (e.g. in the annulus or drill string). The process can be repeated at the request of the drilling operator or automatically at pre-set intervals.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the specification may be incorporated in the invention, whether alone or in any appropriate combination with any other feature disclosed or illustrated herein.

The invention claimed is:

1. A method for use with a managed pressure drilling (MPD) system, the system comprising a drill string having a drill bit, an annulus defined outside of the drill string, a mud pump for pumping mud down through the drill string and back up through the annulus, a control choke in an extraction path coupled to the annulus, a back pressure pump also coupled to the extraction path, and a programmable logic controller (PLC) for controlling the control choke, the method comprising:

a) performing measurements to determine a dataset comprising, for each of a plurality of time steps k: a value of fluid flow rate through the drill bit $q_{bit}[k]$, a value of fluid flow rate through the control choke $q_c[k]$, a value of fluid flow rate from the back pressure pump $q_{bpp}[k]$ and a value of fluid pressure at the control choke $p_c[k]$;

b) executing an inversion algorithm on the PLC to obtain a value for the bulk modulus of a fluid within the annulus, the inversion algorithm taking the dataset as an input, wherein the inversion algorithm accounts for a measurement bias $b_q$ in one or more of said measurements;

c) updating one or more control parameters of the PLC based on the value for the bulk modulus; and d) manipulating the control choke using the PLC to attain a desired pressure in the system.

2. The method according to claim 1, wherein the inversion algorithm of step b) is recursively applied to dataset values corresponding to successive time steps k.

3. The method according to claim 2, wherein the inversion algorithm sequentially solves for the bulk modulus and the measurement bias at each successive time step k.

4. The method according to claim 1, wherein the inversion algorithm minimizes a cost function dependent on the bulk modulus, the measurement bias, and the dataset.

5. The method according to claim 1, wherein the inversion algorithm further comprises a search algorithm which finds the optimal value for the measurement bias given a particular value for the bulk modulus.

6. The method according to claim 5, wherein the search algorithm sequentially narrows the field of search for the optimal value for the measurement bias.

7. The method according to claim 1, wherein the inversion algorithm computes the value for the bulk modulus by evaluating two sums.

8. The method according to claim 1, wherein the inversion algorithm computes an objective function dependent on the bulk modulus, the dataset and the measurement bias, wherein the objective function is expressed as a series of sums.

9. The method according to claim 2, wherein the inversion algorithm simultaneously solves for the bulk modulus and the measurement bias at each successive time step k.

10. The method according to claim 1, wherein the inversion algorithm implements a pseudo-inverse.

11. The method according to claim 1, wherein the inversion algorithm solves a 2×2 linear system of equations.

12. The method according to claim 1, wherein the inversion algorithm takes as further inputs an initial estimate of the maximum and minimum values of the bulk modulus, and wherein the inversion algorithm initially assumes the measurement bias is zero.

13. The method according to claim 1, wherein the values of fluid flow rate through the drill bit $q_{bit}[k]$ are estimated from measurements of fluid flow rate from the mud pump.

14. The method according to claim 1, wherein the dataset is recorded directly after the control choke has been opened or closed.

15. The method according to claim 1, wherein accounting for a measurement bias comprises accounting for calibration offsets in one or more flow meters of the MPD system.

16. The method according to claim 15, wherein the measurement bias $b_q$ is such that, over a time-averaged interval, $q_{bpp}+q_{bit}\times q_c+b_q=0$.

17. The method according to claim 1, wherein the one or more control parameters of the PLC are a gain and/or a time constant.

18. The method according to claim 1, wherein the PLC does not retain the entire dataset in a memory of the PLC.

19. A managed pressure drilling (MPD) system comprising a drill string having a drill bit, an annulus defined outside of the drill string, a mud pump for pumping mud down through the drill string and back up through the annulus, a control choke in an extraction path coupled to the annulus, a back pressure pump also coupled to the extraction path, and a programmable logic controller (PLC) for controlling the control choke, the PLC comprising:

a) a measurement module configured to perform measurements to determine a dataset comprising, for each of a plurality of time steps k: a value of fluid flow rate through the drill bit $q_{bit}[k]$, a value of fluid flow rate through the control choke $q_c[k]$, a value of fluid flow rate from the back pressure pump $q_{bpp}[k]$ and a value of fluid pressure at the control choke $p_c[k]$;

b) a processor configured to execute an inversion algorithm on the PLC to obtain a value for the bulk modulus of a fluid within the annulus, the inversion algorithm taking the dataset as an input, wherein the inversion algorithm accounts for a measurement bias $b_q$ in one or more of said measurements;

c) a memory for storing one or more updated control parameters of the PLC based on the value for the bulk modulus; and d) an output for manipulating the control choke to attain a desired pressure in the system.

20. The system according to claim 19, wherein the inversion algorithm of step b) is recursively applied to dataset values corresponding to successive time steps k when executed.

21. The system according to claim 20, wherein the inversion algorithm sequentially solves for the bulk modulus and the measurement bias at each successive time step k when executed.

22. The system according to claim 19, wherein the inversion algorithm minimizes a cost function dependent on the bulk modulus, the measurement bias, and the dataset when executed.

23. The system according to claim 19, wherein the inversion algorithm further comprises a search algorithm which finds the optimal value for the measurement bias given a particular value for the bulk modulus when executed.

24. The system according to claim 23, wherein the search algorithm sequentially narrows the field of search for the optimal value for the measurement bias when executed.

25. The system according to claim 19, wherein the inversion algorithm computes the value for the bulk modulus by evaluating two sums when executed.

26. The system according to claim 19, wherein the inversion algorithm computes an objective function dependent on the bulk modulus, the dataset and the measurement bias when executed, wherein the objective function is expressed as a series of sums.

27. The system according to claim 20, wherein the inversion algorithm simultaneously solves for the bulk modulus and the measurement bias at each successive time step k when executed.

28. The system according to claim 19, wherein the inversion algorithm implements a pseudo-inverse when executed.

29. The system according to claim 19, wherein the inversion algorithm solves a 2×2 linear system of equations when executed.

30. The system according to claim 19, wherein the inversion algorithm takes as further inputs an initial estimate of the maximum and minimum values of the bulk modulus when executed, and wherein the inversion algorithm initially assumes the measurement bias is zero.

31. The system according to claim 19, wherein the values of fluid flow rate through the drill bit $q_{bit}[k]$ are estimated from measurements of flow rate from the mud pump.

32. The system according to claim 19, wherein the dataset is arranged to be recorded directly after the control choke has been opened or closed.

33. The system according to claim 19, wherein accounting for a measurement bias comprises accounting for calibration offsets in one or more flow meters of the MPD system.

34. The system according to claim 33, wherein the measurement bias $b_q$ is such that, over a time-averaged interval, $q_{bpp}+q_{bit}-q_c+b_q=0$.

35. The system according to claim 19, wherein the one or more control parameters of the PLC are a gain and/or a time constant.

36. The system according to claim 19, wherein the PLC does not retain the entire dataset in a memory of the PLC.

* * * * *